US006956176B2

(12) United States Patent
Castaldo

(10) Patent No.: US 6,956,176 B2
(45) Date of Patent: Oct. 18, 2005

(54) METHOD AND APPARATUS FOR SELECTIVELY LOCKING A STANDARD PLUG TO A STANDARD RECEPTACLE

(75) Inventor: Cosmo Castaldo, Westbury, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/634,901

(22) Filed: Aug. 6, 2003

(65) Prior Publication Data

US 2004/0074745 A1 Apr. 22, 2004

Related U.S. Application Data

(60) Provisional application No. 60/403,253, filed on Aug. 13, 2002.

(51) Int. Cl.[7] ..... H01H 9/20

(52) U.S. Cl. ..... 200/50.28; 200/31; 439/135

(58) Field of Search ..... 200/50.28, 50.29–50.31, 200/50.01, 43.02, 318–322; 439/142, 372, 131, 911, 331

(56) References Cited

U.S. PATENT DOCUMENTS 1,818,290 A * 8/1931 Wulle ..... 200/50.3

3,887,256 A * 6/1975 Klimek et al. ..... 439/142

* cited by examiner

*Primary Examiner*—Elvin Enad
*Assistant Examiner*—M. Fishman
(74) *Attorney, Agent, or Firm*—Paul J. Sutton

(57) ABSTRACT

An enclosure which supports a standard receptacle for receiving a standard plug and a handle which can be positioned to a first position or a second position is provided. The handle, when in the first position, blocks the removal or insertion of the plug into the receptacle. In the fist position, the receptacle can be selectively connected by a user to a source of power. When the handle is in the second position, the plug can be removed or inserted into the receptacle and the receptacle is prevented from being connected to the source of power. The apparatus includes a receptacle, a switch for turning power to the receptacle on or off, a member coupled to the housing and having a first position which prevents the plug from being inserted into or removed from the receptacle and a second position which allows the plug to be inserted into or removed from the receptacle, and a connector coupled to the member and to the switch to enable the switch to connect the receptacle to a source of power when the member is in the first position. The apparatus also includes a housing for containing the receptacle and mounting lugs for mounting the apparatus.

14 Claims, 4 Drawing Sheets

FIG.2a
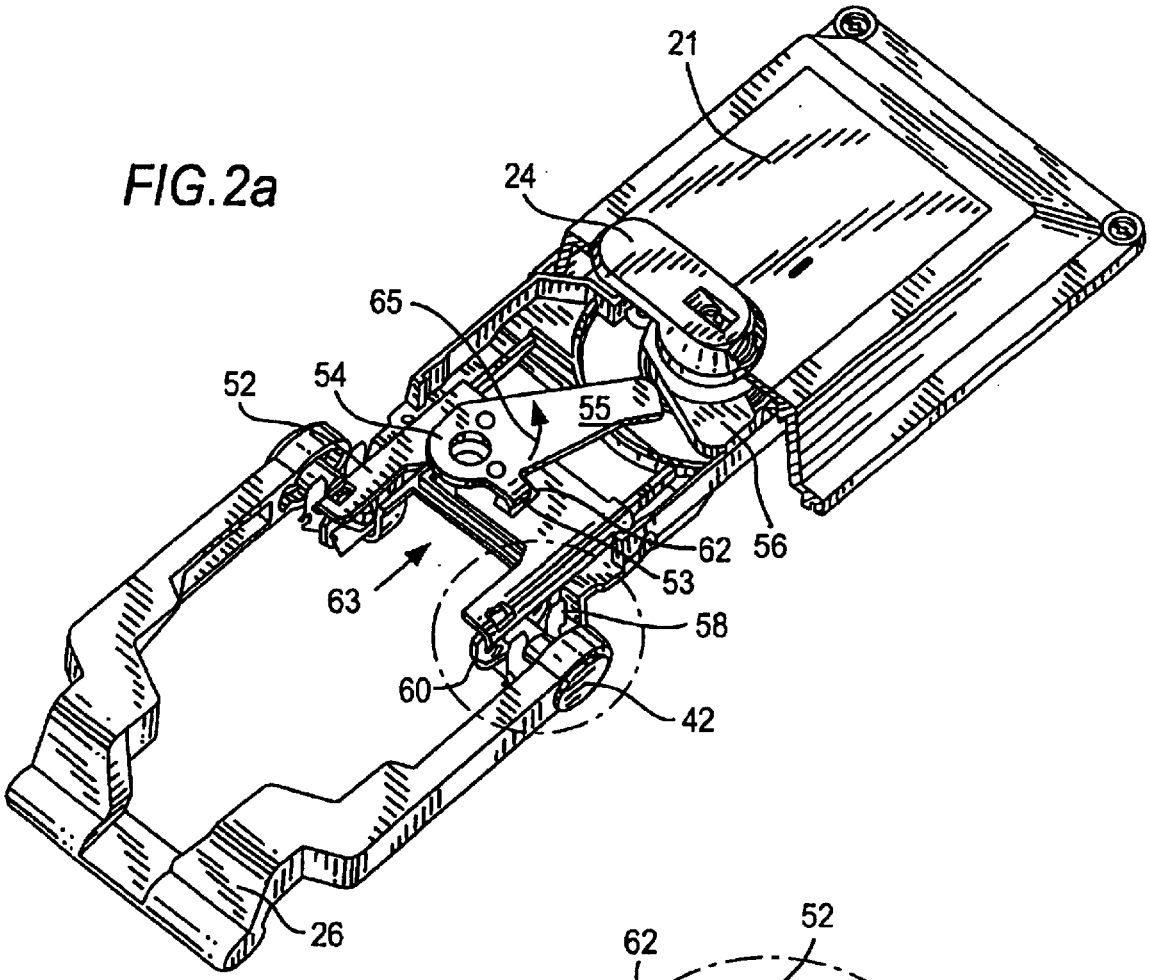
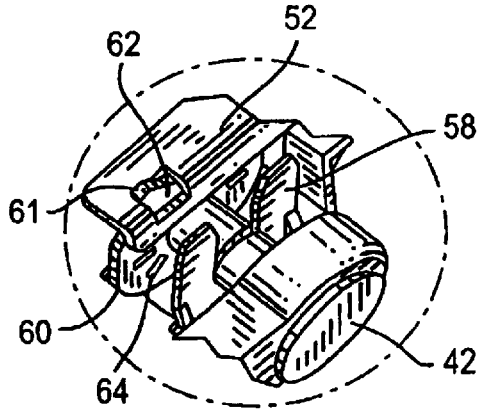
FIG.2b

METHOD AND APPARATUS FOR SELECTIVELY LOCKING A STANDARD PLUG TO A STANDARD RECEPTACLE

REFERENCE TO RELATED APPLICATIONS

This application claims priority pursuant to 35 U.S.C 119(e) from U.S. Provisional Patent Application having application Ser. No. 60/403,253, filed Aug. 13, 2002.

BACKGROUND OF THE INVENTION

1. Field of the Invention

The present invention relates generally to electrical connectors and more particularly to controlling the coupling of a source of power to a standard receptacle while selectively blocking or permitting a standard plug to be connected to the receptacle.

2. Description of the Related Art

It is desirable to have devices to capture and hold plugs when they are inserted into receptacles. Some standards governing some electrical receptacles require the receptacle to be switched off when no plug is actually inserted into the receptacle and prevent power from being provided to the receptacle when no plug is inserted into the receptacle.

Various locking principles using diverse mechanisms between the switch and the receptacle have previously been proposed, such that the operation of the switch is conditional on the presence of a plug in the receptacle and mechanical locking of the plug in the receptacle when the receptacle is switched on. In most of these devices, specialized plugs and receptacles with attached locking mechanisms are used. In one device, electrical conductors are terminated in special connectors which permit locking to be carried out using special locks on both the plug and receptacle. However, connectors which are not of the required types cannot be joined. What is desired is an interlocking structure which allows a standard plug to be inserted into or removed from a standard receptacle only when the receptacle cannot connected to a source of power and to prevent the plug form being inserted into or removed from the receptacle when the receptacle can be connected to a source of power.

Some devices have provided a direct mechanical linkage extending from the receptacle to the switch in such a manner that insertion of the plug turns the switch "on" and removal of the plug turns the switch "off".

SUMMARY OF THE INVENTION

The present invention provides an enclosure which supports a standard receptacle for receiving a standard plug, a switch, and a handle which can be positioned to a first position or a second position. When the handle is in the first position, the plug can be removed or inserted into the receptacle and the receptacle is prevented from being connected to the source of power by means of a mechanism that prevents a switch within the enclosure from being moved to the on position. The handle, when in the second position, blocks the removal or insertion of the plug into the receptacle, and in this position, the receptacle can be selectively connected by a user to a source of power by means of the switch.

An apparatus for controlling the coupling of a source of power to a standard receptacle while selectively blocking or permitting a standard plug to be connected to the receptacle is provided. The apparatus includes a receptacle, a switch for turning power to the receptacle on or off, a member coupled to the housing and having a second position which prevents the plug from being inserted into or removed from the receptacle and a first position which allows the plug to be inserted into or removed from the receptacle, and a connector coupled to the member and to the switch to enable the switch to connect the receptacle to a source of power when the member is in the second position. The apparatus also includes a housing for containing the receptacle and mounting lugs for mounting the apparatus.

BRIEF DESCRIPTION OF THE DRAWINGS

Other aspects, features and advantages of the present invention will become more fully apparent from the following detailed description, the appended claims, and the accompanying drawings in which similar elements are given similar reference numerals.

FIG. 2*a* is a cut away view depicting the apparatus of the present invention in one position;

FIG. 2*b* is a first enlarged cut away view depicting a first portion of FIG. 2*a;*

DETAILED DESCRIPTION OF THE INVENTION

Figure 1:
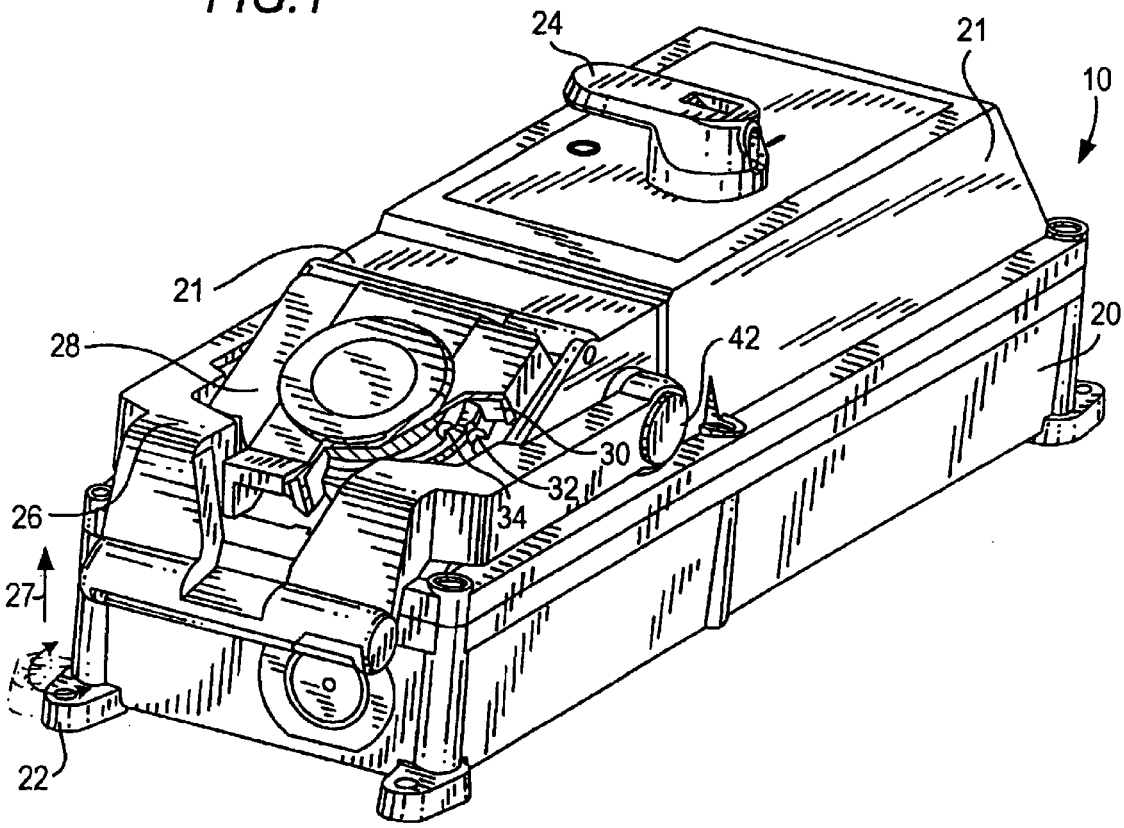
FIG. 1 is a first perspective view depicting the apparatus of the present invention.

The device 10 is a self-contained switch and receptacle enclosure having a locking means for locking a plug into the receptacle and for locking the switch in a predetermined position Referring to FIG. 1, the device 10 is shown having a box bottom 20. Fastened to the box bottom 20 is the box top 21. Extending from the box bottom 20, are mounting lugs 22 which are provided for mounting the device to a structure such as an I beam. On one end of the device 10, a receptacle 23 (not shown) is mounted adjacent to the box top 21. Attached to the receptacle 23, is a receptacle cover 28 having a waterproof gasket 30. Positioned around the receptacle 23, a second gasket 34 is provided. A gasket hold down clamp 32 is provided to keep the gasket 30 in place. A switch 24 is mounted on the box top 21. A shaft 42 is provided for mounting a lever 26 so that the lever 26 may swing in the direction shown by arrow 27, between a first (lower) position and a second (upper) position. The lever 26 is pivotally coupled to the box top 21. The lever 26 can assume a first (lower) position as shown in FIG. 1 which allows a plug (not shown) to be inserted into or removed from the receptacle 23. When the handle 26 is at this lower position, switch 24 is locked in the off position.

The on-off control switch 24 is provided to allow a user to selectively electrically connect the receptacle 23 to a cable 44 which is connected to a power supply (not shown) when the lever 26 is in its upper position. When the lever 26 is in its lower position the switch 24 is prevented from connecting the receptacle 23 to a source of power (not shown). The mechanism that prevents the switch 24 from connecting the receptacle 23 is discussed below.

The lever 26 and the switch 24 are interlinked. The mechanism for linking the lever 26 and switch 24 are discussed below. When the lever 26 is in its lower position, a plug (not shown) can be inserted into or removed from the receptacle 23. When in this position, the switch 24 is mechanically prevented from being turned to its on position. Also, when the lever 26 is moved into the lower position, the switch 24 is moved by the lever 26 to its off position and locked in the off position as discussed below. At this time power cannot be applied to the receptacle 23. Thus, when the lever 26 is in its lower position, the switch 24 is automatically moved to the off position to prevent the receptacle 23 from being connected to the source of power (not shown), the plug (not shown) can be freely inserted into or removed form the receptacle 23 and the user cannot connect the receptacle 23 to the source of power (not shown) which is being fed to device 10. The receptacle 23 can not be connected to the source of power if the plug (not shown) can be inserted into or removed from the receptacle 23 as discussed below.

The mechanisms for linking the lever 26 and the switch 24 will now be described. Referring now to FIG. 2*a*, the internal assembly and linkages of the device 10 are shown. Inside device 10 there are two internal linkages, linkage 52 and linkage 54. Linkage 52 is shaped as an upside-down, square 'U'. The width of the linkage 52 spans the majority of the internal width of the box top 21. Linkage 52 moves in response to the lever 26. When the lever 26 is in the lower position, the device 10 is prevented from being energized. When this occurs, linkage 52 assumes a first lower position since it is connected to lever 26 as described below. When the lever 26 is in the upper position, where the device 10 can be energized, linkage 52 moves to a second or higher position as described below.

Figure 2C:
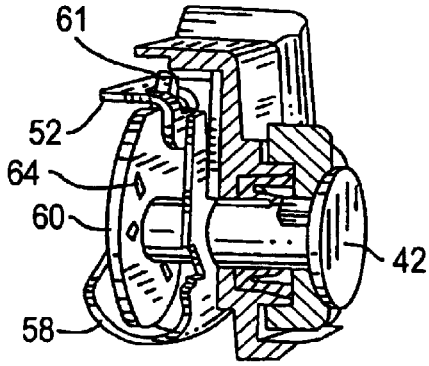
FIG. 2*c* is a second enlarged cut away view depicting a second portion of FIG. 2*a;*

Referring now to FIG. 2*b* a portion of linkage 52 is shown. A spring clip 58 and indexer 60 are incorporated into the device 10 disposed around the shaft 42 of the lever 26. The clip 58 is mounted such that it straddles the indexer 60 which rotates with the lever 26 as it is attached to the shaft 42 which is attached to lever 26. The clip 58 has two diametrically opposed knubs (not shown) which snap into corresponding holes 64 in the indexer 60. There are a total of four such holes 64 in the indexer 60 which engage the knubs (not shown) of the clip 60. Two correspond to the lower position of lever 26, and two correspond to the upper position of the lever 26. The indexer 60 is attached to linkage 52 by a protrusion 61 of indexer 60 protruding through a hole 62 in linkage 52. Therefore, when lever 26 moves from the upper position to the lower position or vice versa, the shaft 42 rotates, thereby rotating indexer 60. When indexer 60 rotates, the protrusion 61 rotates, causing linkage 52 to move in the direction of arrow 63. Also, as better shown in FIG. 2*c*, as linkage 60 rotates, the knubs (not shown) on clip 58 catch the holes 64 in the indexer 60. The holes 64 correspond to the upper and lower position of lever 26, and the knubs (not shown) rest in holes 64 to keep lever 26 in either its upper or lower positions.

Referring to FIG. 2*a*, linkage 54 is an arm that tapers toward its outer end 55. On its wider end, it is mounted on a free rotation axis. Also towards the wider end, there is a tab 53 on linkage 54 which is perpendicular to its main body. This tab 53 extends inward, and passes through hole 62 in linkage 52. The interaction of linkage 52 and linkage 54 is such that, when lever 26 is lifted from the lower position, linkage 52 moves in the direction of arrow 63. This movement then causes the tab 53 on linkage 54 to move as well and causes linkage 54 to rotate in the counter-clockwise direction as shown by arrow 65. Conversely, when the lever 26 is lowered from the upper position to the lower position, linkage 54 rotates in the clockwise direction, the opposite direction of arrow 65 back to the state shown in FIG. 2*a*.

The switch 24 that energizes the device 10 has a cam 56 attached to its axis inside the device 10. The cam 56 is roughly pear or teardrop shaped and rotates as switch 24 is rotated. When linkage 54 is in its clockwise position as shown in FIG. 2*a*, when the lever 26 in the lower position, the switch 24 may only be in the off state as the end 55 of linkage 54 blocks the cam 56 from rotating, thereby keeping switch 24 in the off state.

Figure 3:
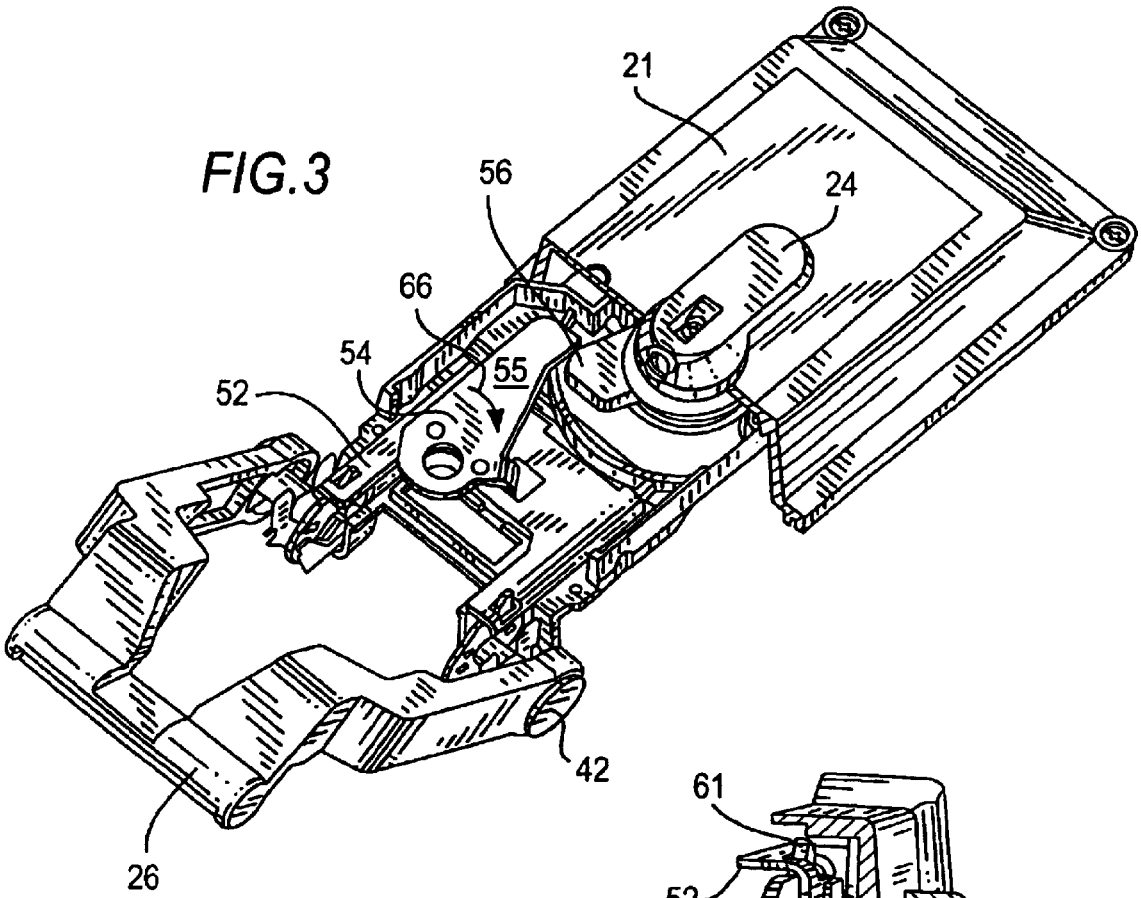
FIG. 3 is a second cut away view depicting the apparatus of the present invention having a plug coupled thereto.

Referring now to FIG. 3, the cam 56 interacts with linkage 54 such that when linkage 54 is in its position shown in FIG. 3, and the lever 26 is in the upper position, the switch 24 is free to be rotated between the on and off states. If the device 10 is energized, meaning switch 24 is in the on position, while the lever 26 is moved from the upper position shown in FIG. 3 to the lower position shown in FIG. 2, linkage 54 rotates in the direction of arrow 66, and moves the cam 56 thereby forcing the switch 24 to the off state.

Figure 4:
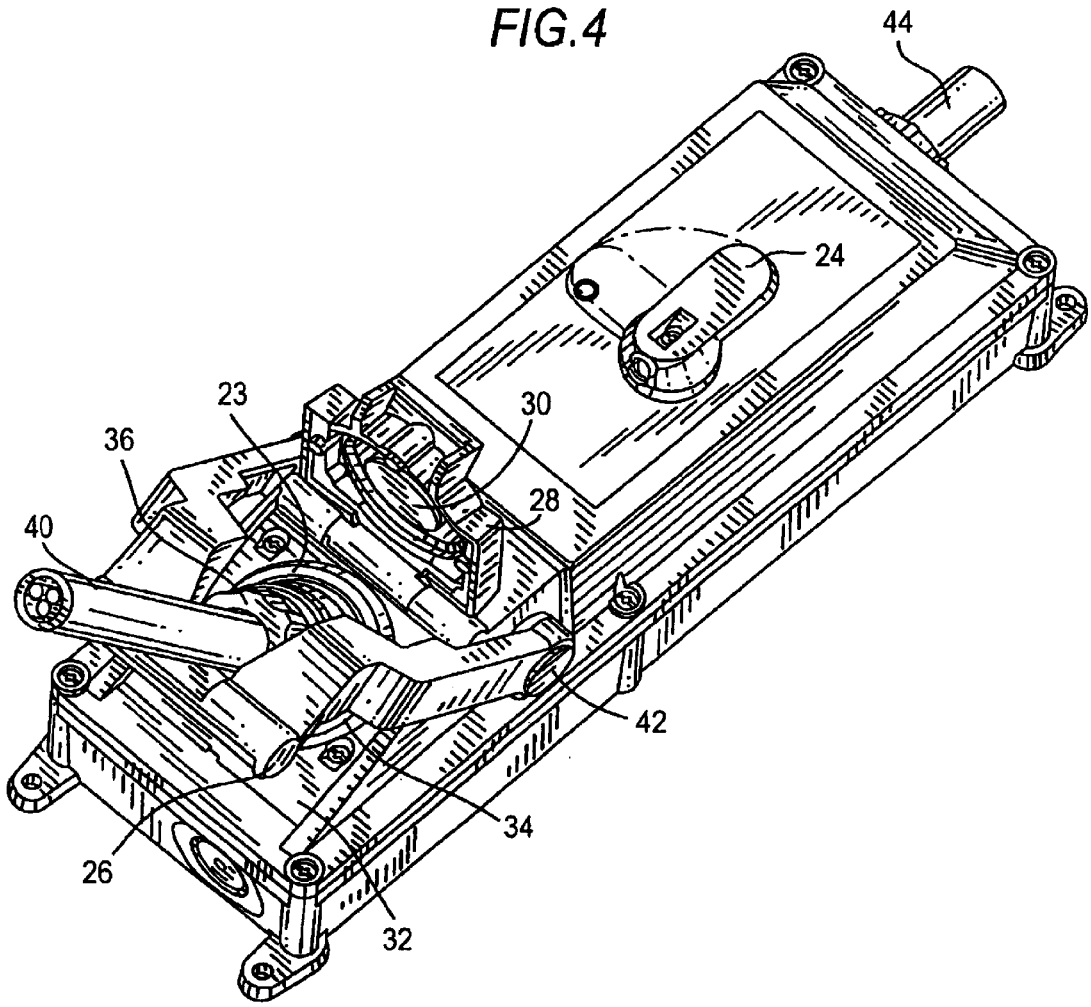
FIG. 4 is a second perspective view depicting the apparatus of the present invention having a plug coupled thereto.

Referring now to FIG. 4, the plug 36 is provided so that it may be removably connected to the receptacle 23. A plug wire 40 is attached to the plug 36. A cable 44 attached to a power supply is attached to the device 10. The lever 26 is movable to an upper position as shown in FIG. 4 to lock plug 36 into receptacle 23 by straddling the plug 36 and plug wire 40. The plug 36 and receptacle 23 may be of many different types such as a standard, 2-prong, three phase, etc. The plug 36 and receptacle 23 each may be of the male or female variety. The lever 26 is pivotally coupled to the box top 21. The lever 26 can assume an upper position to cover at least a portion of the receptacle 23 to block a plug 36 from being inserted into receptacle 23. The lever 26 straddles the plug 36 and wire 40 to prevent the plug 36 from being removed from the receptacle 23 as shown in FIGS. 3 and 4. The lever 26 may also assume a lower position as shown in FIGS. 1 and 2*a* which allows the plug 36 to be inserted into or removed from the receptacle 23.

When the lever 26 is in its upper position, it will straddle and shroud the receptacle 23. Thus, if there is no plug 36 in the receptacle 23, the lever 26 will prevent a plug 36 from being inserted into the receptacle 23 and, if a plug 36 is in the receptacle 23, the lever 26 will prevent the plug 36 from being removed. When the lever handle 26 is in its lower position, the lever 26 allows the on-off switch 24 to switch power to the receptacle 23 as needed.

The device 10 here disclosed can be used with water tight receptacles through the addition of gaskets and boots where required. Additionally, an LED indicating light can be located behind a clear window in the front face of the device 10 to indicate if the receptacle is energized, and a fused switch module can be used in place of the simple on-off switch 24.

While the invention has been described with respect to a limited number of embodiments, it will be appreciated that many variations, modifications and other applications of the invention may be made.

What is claimed is:

1. A device comprising:

a receptacle:

a switch for turning power to said receptacle on or off;

connecting means coupled to control said switch to selectively enable said switch to connect said receptacle to a source of power;

a lever coupled to said connecting means and having a first position which allows a plug to be inserted into or removed from said receptacle while, at the same time, preventing said switch from coupling said receptacle to a source of power, and a second position which prevents the plug being inserted into or removed from said receptacle while, at the same time, allowing said switch to couple said receptacle to a source of power, even when the plug is not in said receptacle.

2. The device of claim 1 wherein said connecting means disables said switch from connecting said receptacle to a source of power when said lever is in said first position.

3. The device of claim 1 wherein said connecting means turns said switch to the off position when said lever is moved from the second position to said first position.

4. The device of claim 1, wherein the plug and the receptacle are standard electrical wiring components.

5. The device of claim 1 further comprising a mounting lug disposed on a housing for housing the device.

6. The device of claim 1 further comprising a gasket mounted on said receptacle.

7. The device of claim 6 further comprising a gasket hold down clamp mounted on said receptacle.

8. The device of claim 1, wherein said connecting means comprises a first linkage and a second linkage, said first linkage and said second linkage are connected to each other.

9. The device of claim 8, wherein said first linkage is connected to said lever.

10. The device of claim 8, wherein said second linkage is operable to operate said switch.

11. The device of claim 8 further comprising a cam attached to said switch.

12. The device of claim 11, wherein said second linkage is operable to move said cam thereby moving said switch.

13. The device of claim 1 further comprising:

a spring clip attached to said lever; and an indexer operably attached to said spring clip to cause said lever to remain in first or second positions.

14. The device of claim 13, further comprising:

knubs attached to said spring clip; and indentations disposed on said indexer, such that said knubs on said spring clip fit into said indentations.

* * * * *

UNITED STATES PATENT AND TRADEMARK OFFICE

CERTIFICATE OF CORRECTION

PATENT NO. : 6,956,176 B2
DATED : October 18, 2005
INVENTOR(S) : Cosmo Castaldo

It is certified that error appears in the above-identified patent and that said Letters Patent is hereby corrected as shown below:

Column 1,
Line 38, after “cannot”, insert -- be --;

Column 4,
Line 41, delete “lower”, and insert -- upper --; and

Column 5,
Line 1, after “plug”, insert -- from --.

Signed and Sealed this

Thirteenth Day of June, 2006

JON W. DUDAS
*Director of the United States Patent and Trademark Office*